US007551061B2

(12) United States Patent
Blackman

(10) Patent No.: US 7,551,061 B2
(45) Date of Patent: Jun. 23, 2009

(54) SOUND GENERATOR: A PIEZOELECTRIC BUZZER ON A FLEXIBLE, TENSIONED SURFACE OF AN INFLATABLE OBJECT

(75) Inventor: John A. Blackman, Englewood, NJ (US)

(73) Assignee: Sing-A-Tune Balloons, LLC, Boca Raton, FL (US)

( * ) Notice: Subject to any disclaimer, the term of this patent is extended or adjusted under 35 U.S.C. 154(b) by 0 days.

(21) Appl. No.: 10/976,730

(22) Filed: Oct. 29, 2004

(65) Prior Publication Data

US 2005/0057343 A1 Mar. 17, 2005

(51) Int. Cl.
*G08B 3/10* (2006.01)

(52) U.S. Cl. ..... 340/384.6; 273/381; 340/384.1; 340/384.73; 446/220

(58) Field of Classification Search ..... 340/384.1, 340/384.5, 384.6, 384.7, 384.73, 388.1; 181/148, 181/153; 446/220, 222, 225, 397; 40/455; 362/267, 253, 96; 273/381; 381/90, 173, 381/190–191; 367/155
See application file for complete search history.

(56) References Cited

U.S. PATENT DOCUMENTS

| | | | | |
|---|---|---|---|---|
| 3,478,343 | A | 11/1969 | Wallace | |
| 3,649,789 | A | 3/1972 | Stoll | 200/82 R |
| 3,740,543 | A | 6/1973 | Franc | 240/6.4 R |
| 4,464,861 | A | 8/1984 | Fogarty et al. | 446/370 |
| 4,638,207 | A | 1/1987 | Radice | 310/328 |
| 4,704,934 | A | 11/1987 | Nosrati | 446/220 |
| 4,737,981 | A | 4/1988 | Hoberman et al. | 379/112 |
| 4,817,138 | A | 3/1989 | Thomke et al. | 379/433 |
| 4,823,907 | A | 4/1989 | Hoshi | 181/148 |
| 4,920,674 | A | 5/1990 | Shaeffer | 40/412 |
| 4,922,527 | A | 5/1990 | Nonami | 379/361 |
| 5,054,778 | A | 10/1991 | Maleyko | 446/425 |
| 5,108,338 | A | 4/1992 | Margolis | 446/220 |
| 5,115,472 | A | 5/1992 | Park | 40/455 |
| 5,157,712 | A | 10/1992 | Wallen, Jr. | 379/74 |
| 5,215,492 | A | 6/1993 | Kubiatowitz | 446/219 |
| 5,309,519 | A | 5/1994 | Park | 40/455 |
| 5,403,222 | A | 4/1995 | Koenig et al. | 446/220 |
| 5,445,026 | A | 8/1995 | Eagan | 434/319 |
| 5,556,100 | A | 9/1996 | Bloomfield et al. | 358/402 |
| 5,559,611 | A | 9/1996 | Bloomfield et al. | 358/407 |
| 5,609,411 | A | 3/1997 | Wang | 362/234 |

(Continued)

FOREIGN PATENT DOCUMENTS

| | | |
|---|---|---|
| CN | 1258904 | 7/2000 |

OTHER PUBLICATIONS

Paradiso, J.A., The interactive balloon: Sensing, actuation, and behavior in a common object, IBM Systems Journal, 1996, 473-487, vol. 35, Nos. 3&4, IBM, USA.

*Primary Examiner*—Brent Swarthout
(74) *Attorney, Agent, or Firm*—Baker & Hostetler LLP

(57) ABSTRACT

A sound generator and method of projecting sound that includes a piezoelectric buzzer secured to a tensioned, flexible surface of an inflatable object, the surface being under tension in response to variations of pressure within the object. The sound generator includes a sound source and a piezoelectric buzzer electrically connected with each other so that the sound source generates signals, the piezoelectric buzzer converts the signals into sounds and the tensioned, flexible surface amplifies the sounds.

38 Claims, 5 Drawing Sheets

U.S. PATENT DOCUMENTS 5,648,129 A 7/1997 Lee et al. ..... 40/455
5,662,510 A * 9/1997 Wolens ..... 446/397
5,669,702 A 9/1997 Wang ..... 362/234
5,725,445 A 3/1998 Kennedy ..... 473/570
5,782,668 A 7/1998 Chabert ..... 446/220
5,795,211 A * 8/1998 Carignan et al. ..... 446/220
5,893,798 A 4/1999 Stambolic et al. ..... 463/46
5,936,521 A 8/1999 Blackman ..... 340/540
6,012,826 A 1/2000 Chabert ..... 362/363
6,238,067 B1 5/2001 Hirsch ..... 362/352
6,482,065 B1 * 11/2002 Blackman ..... 446/220
D469,429 S 1/2003 Blackman ..... D14/299
6,632,120 B2 10/2003 Blackman et al. ..... 446/220
6,821,183 B2 11/2004 Blackman et al. ..... 446/220
7,177,434 B2 * 2/2007 Tripoli ..... 381/190
2003/0138120 A1 7/2003 Tripoli, III
2004/0116039 A1 * 6/2004 Mueller et al. ..... 446/220
2005/0057343 A1 * 3/2005 Blackman ..... 340/384.6

* cited by examiner

SOUND GENERATOR: A PIEZOELECTRIC BUZZER ON A FLEXIBLE, TENSIONED SURFACE OF AN INFLATABLE OBJECT

CROSS-REFERENCE TO RELATED APPLICATIONS

This application is related to U.S. patent application Ser. No. 09/301,800 to Blackman, filed Apr. 29, 1999 which is a continuation-in-part of U.S. Pat. No. 09/223,920 to Blackman, filed Dec. 31, 1998, both now abandoned.

BACKGROUND OF THE INVENTION

1. Field of the Invention

The invention relates to novelty items capable of generating polyphonic sounds. Specifically, the present invention relates to novelty balloons having a piezoelectric buzzer configured to generate polyphonic sounds.

2. Discussion of Related Art

Piezoelectric films are known conventionally. An article by J. Paradiso entitled "The interactive balloon: Sensing, actuation, and behavior in a common object" and published in IBM SYSTEMS JOURNAL, Vol. 35, Nos. 3&4 (1996) mentions that:

> The key to endowing the balloon with hearing and speech is a sheet of piezoelectric polyvinylidene fluoride (PVDF) film, which is a semicrystalline homopolymer; i.e., a polymer in a mixture of crystalline and amorphous states.

The PVDF film referenced above cannot endow a balloon with the ability to reproduce high quality sounds. Indeed, the cost factor in the manufacture and use of such piezoelectric films is an impediment to the rapid commercialization of such acoustic transducers, such as for party balloons equipped with piezoelectric technology. Additionally, to produce a good quality sound with this film, a large amplifier is required, hence, making the balloons heavy and unable to float as well as commercially unviable.

Balloon manufacture in the industry is highly automated in order to generate finished balloons at a rapid rate. This means that the production of balloons incorporating film piezoelectric systems with necessary electronics cannot be currently automated to keep up with the rapid rate at which balloons are manufactured.

Further, film piezoelectric systems present difficulties in assembly. Specifically, the difficulties arise during assembly of electromechanical connections of the piezoelectric film and a printed circuit board. This requires complicated and expensive use of special connectors, which are not reliable.

Also, the piezoelectric film relies heavily on the tension of a fully inflated and rigid balloon in order to function efficiently. The film is very soft and pliable. In order for it to reproduce sounds (especially voice and music sounds) at a reasonable level of volume and quality, it must rely on the rigidity of the balloon. If the balloon deflates for any reason and becomes flaccid, the sound quality and volume coming from the piezoelectric film will be compromised.

Oftentimes, balloons filled with helium or air become deflated and lose their rigidity. This typically happens within days of inflating the balloon, because the balloons lose air or helium through their valve system and permeation of the gasses through the balloon film. Hence, balloons become flaccid with the passage of time. As the balloons are carried from place to place, they also lose their rigidity due to changes in temperature and pressure. Even a small change in temperature or air pressure has an effect on the rigidity of the balloon.

This effect may be readily visualized by bringing a balloon inside one's house from the outdoors. There is invariably a difference in rigidity that ensues. In the summer, a balloon filled in the typical summer temperature conditions can be flaccid when brought into an air conditioned environment indoors. With relatively small changes in temperature, a difference in air pressure in the balloon results.

Piezoelectric crystals/ceramic buzzers are disclosed, for instance in U.S. Pat. No. 4,737,981 entitled "Telephone control device", U.S. Pat. No. 4,922,527 entitled "Small electronic apparatus" that identifies PIEZO Co., LTD of Japan as a provider of piezoelectric buzzers, U.S. Pat. No. 5,157,712 entitled "Telephone nuisance call mitigation screening device", U.S. Pat. No. 5,559,611 entitled "Facsimile store and forward system with local interface" and U.S. Pat. No. 5,555,100 entitled "Facsimile store and forward system with local interface translating DTMF signals into store and forward system commands" that identifies a piezo speaker under model PKM 17EPT-4001 of Murata-Erie of Smyma, Ga. The contents of each of these patents is incorporated herein by reference.

A conventional sound module includes a piezoelectric buzzer, sound chip, mechanical switch, printed circuit board and all electronics and batteries contained within a common housing and identified as a Musical Sticker from a company named MEGA SOUND (USA) LLC of Brooklyn, N.Y. The Musical Sticker has the following directions: attach it to any card, paper. The melody will be generated whenever you press the sticker. Remove the rear paper of button and put on the suitable location. The Musical Sticker can be used for any kind of card, letter, gift box, notebook, calendar and so on. The Musical Sticker plays over 1,000 times.

If these directions are followed and the common housing is stuck onto the card, letter, gift box, notebook, calendar or solid objects of that type, the sound level is faint from the piezoelectric buzzer and the quality of sound is therefore tinny and poor. None of these recommended surfaces are in any way tensioned.

To operate the Musical Sticker, the switch is pressed against bias into contact with a metallized surface of the printed circuit board to actuate triggering circuitry. The triggering circuitry triggers the piezoelectric buzzer to generate sounds in accordance with signals from the sound chip. The entire assembly is housed within a common housing that includes a plastic cover that flexes to permit actuation of the switch and a plastic film bottom on which is applied an adhesive for sticking to a surface of an object.

Further, conventional piezoelectric films or buzzers that are currently incorporated into novelty items capable of producing only monophonic or single frequency sounds. Typically, these sound-producing elements are called single-tone generators. One of the disadvantages of the single-tone generators is that they are incapable of playing melodies, songs, or other continuous multi-tone sounds, i.e., polyphonic sounds. Hence, they would not be very effective in playing out a "Happy Birthday" song to a recipient.

Thus, there is a need to have a balloon (novelty or otherwise) having a piezoelectric buzzer attached to balloon's continuously tensioned surface and capable of generating polyphonic sounds. The balloon is capable of generating polyphonic sounds with its sound producing module even if it becomes deflated. This is because the sound producing module is attached to balloon's continuously tensioned surface. Further, there is a need to utilize acoustic abilities of the balloon to amplify sounds generated by the piezoelectric buzzer, as well as, produce better sound projection (loudness), better clarity of sound, and broader frequency range.

BRIEF SUMMARY OF THE INVENTION

One aspect of the invention resides in a sound generator that includes a piezoelectric buzzer secured to a flexible, tensioned surface of an inflatable object, such as a balloon.

In an embodiment, the present invention is a balloon for producing polyphonic sounds. The balloon has inside and outside surfaces and an enclosed gas expandable interior that is encompassed by the inside surface. The balloon includes an inlet for the controlled entry of a gas into the enclosed expandable interior. The balloon also includes a piezoelectric buzzer (that is not a piezoelectric film) adhered to the balloon for producing polyphonic sounds. The piezoelectric buzzer is adhered to one of balloon's inside or outside surfaces so that upon receiving audio signals generated by a voice/sound chip, the signals are converted into polyphonic sounds that resonate within the balloon. The balloon serves as an amplifier of the polyphonic sounds. The piezoelectric buzzer is configured to operate while the a portion of the inside or outside surface to which it is attached is continuously tensioned. The balloon can be manufactured from a metallized nylon film, clear plastic film, EVOH material, or any other suitable material.

The balloon also has a sound module electrically connected to the piezoelectric buzzer and secured to the balloon. The sound module includes a circuit with the voice/sound chip. The voice/sound chip is adapted to generate the audio signals. The balloon also includes at least one battery arranged to power the sound module.

In an alternate embodiment, the balloon includes a common housing for the piezoelectric buzzer and the sound module. Further, the balloon includes a triggering mechanism that is responsive to touch and that renders the sound module operative through triggering the voice/sound chip to generate the audio signals. Also, the polyphonic sounds can be songs, melodies, speech, and continuous multiple frequency sounds.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE INVENTION

Figure 1:
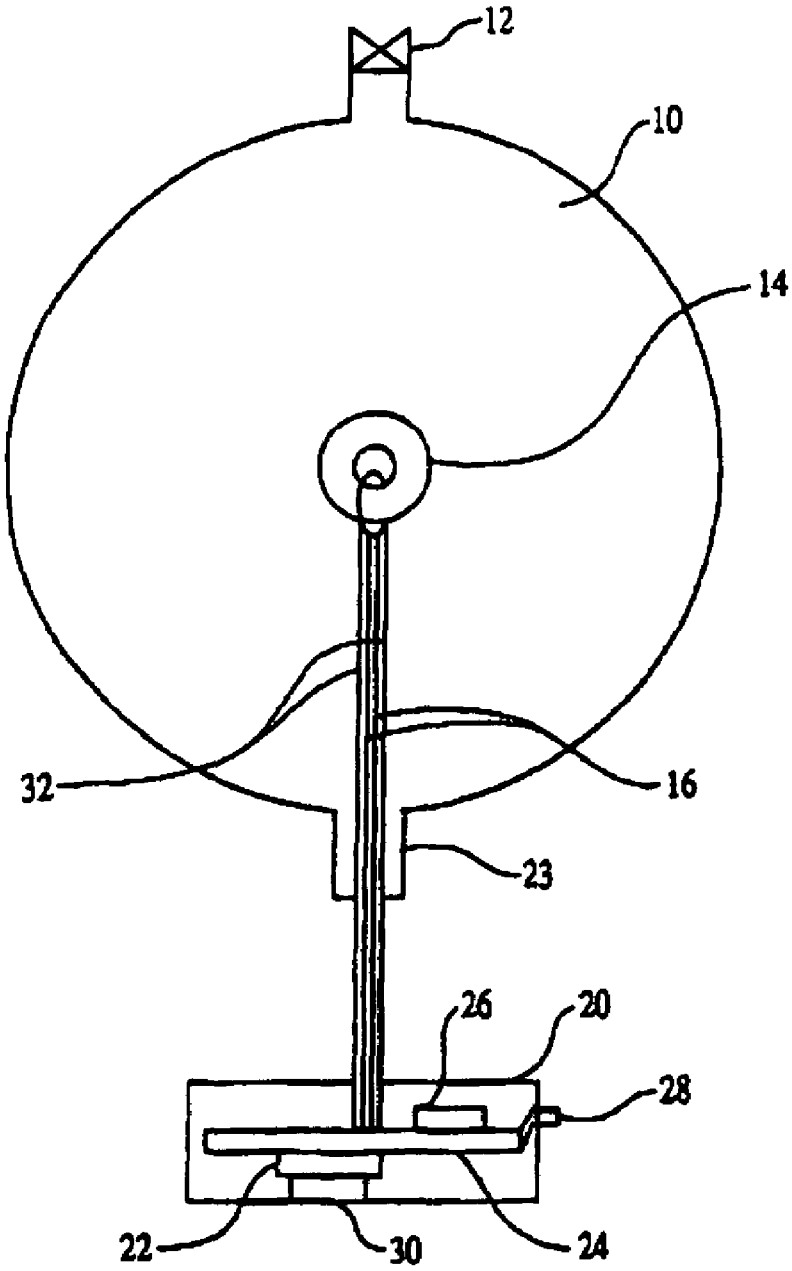
FIG. 1 illustrates an embodiment of the balloon with a piezoelectric buzzer arranged on its external surface, according to the present invention.

FIG. 1 shows a balloon 10, which can be inflated through an inlet valve 12 to be filled with a gas such as air, a lighter than air gas such as helium, or a heavier than air gas. The balloon has a sheath or skin that is expandable under gaseous forces inside the balloon. The balloon can be manufactured from plastic, plastic film, metallized nylon-type, non-metallized nylon-type material, EVOH material and other film suitable for inflating.

A piezoelectric buzzer 14 is permanently adhered to the outside surface of sheath or skin of the balloon 10. The piezoelectric buzzer 14 is preferably of a dimension between 27 and 50 mm.

Conductive strands 16 may be printed on a plastic film to form a ribbon conductor 32 in a known manner. An electromechanical connection can connect terminals of the piezoelectric buzzer 14 to respective conductive strands 16.

Figure 2:
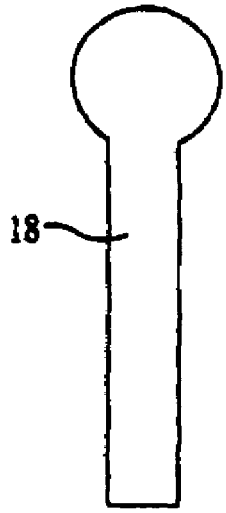
FIG. 2 illustrates a decorative cover suitable to protect and camouflage the piezoelectric buzzer shown FIG. 1, according to the present invention.

A decorated cover 18, shown in FIG. 2, is provided with an adhesive backing and applied over the outer facing surface of the piezoelectric buzzer 14 and ribbon conductor. For instance, the cover 18 is preferably made from the same material used to make the balloon 10. In an embodiment, the cover 18 can be a die cut and printed with a decoration conforming with the appearance of the balloon so as to blend in with the same.

A plastic housing 20 contains a sound module 22. The sound module includes a printed circuit board 24 with a voice/music chip 26, a switch 28, button cell batteries 30 and other electronic components and conductors necessary to render operative the circuitry of the sound module 22. The components and circuit arrangement of the sound module 22 may be of any conventional design and manufacture such as that disclosed in U.S. Pat. No. 4,638,207, whose contents are incorporated herein by reference. The switch 28 may be mechanical, electrical, or electro-mechanical type, such as infrared, motion detector, piezoelectric film, etc. or be the piezoelectric buzzer itself.

The housing 20 is preferably hand-held to eliminate the weight of the sound module from being carried by the balloon, thereby avoiding flotation problems that might otherwise arise. If the housing 20 with sound module 22 is light enough to avoid flotation problems, it may be secured to the balloon, e.g., the mouth 23 of the balloon.

To operate the sound module 22, the switch 28 is moved from an open position to a closed position in any conventional manner. In response to the switch 28 entering into the closed position, the voice/music chip 26, powered by the batteries 30, sends audio signals through the conductive strands 16 that are in accord with programmed voice/music or other sounds.

The voice/music chip 26 may be arranged on the printed circuit board 24. As would be understood by one having ordinary skill in the relevant art, the voice/music chip 26 can be located at other locations other than the printed circuit board 24, such as, on the ribbon conductor 32. The switch 28 may be replaced by the piezoelectric buzzer itself or a strip of piezoelectric film with associated circuitry adhered to the balloon, in which case the strip flexes to trigger the sound module 22 to operate.

The piezoelectric buzzer 14 responds to the audio signals by converting the signals into sounds and enunciating the same, thereby serving as a speaker. The sounds resonate, generating amplified sounds corresponding to the voice/music. In an embodiment, the piezoelectric buzzer 14 is configured to produce polyphonic sounds, such as songs, speech, melodies, sound effects, mixed music/sounds, and/or other continuous multiple frequency sounds. In an alternate embodiment, the piezoelectric buzzer 14 is configured to produce monophonic sounds, such as single tones without varying frequencies of the sounds or producing continuous melodies.

Figure 3:
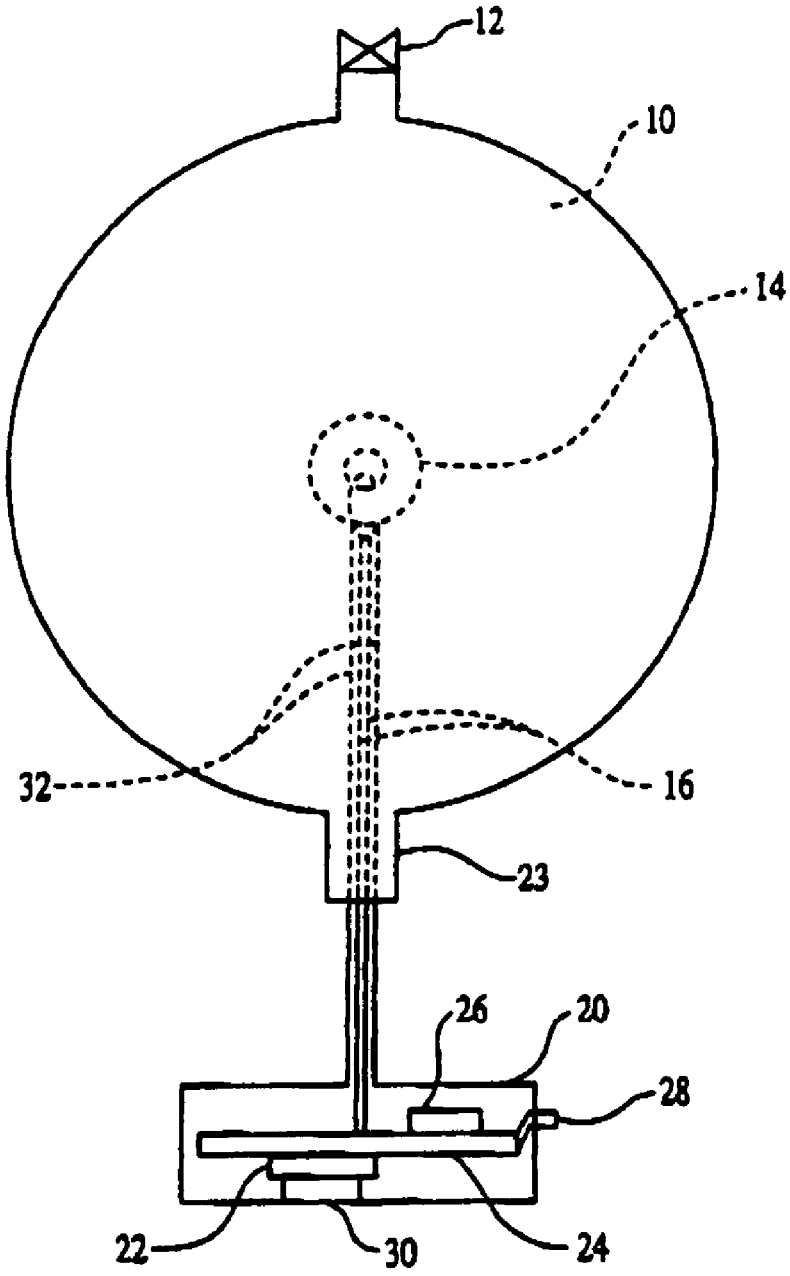
FIG. 3 illustrates an embodiment of the balloon with a piezoelectric buzzer arranged on its internal surface, according to the present invention.

FIG. 3 shows a variation of the embodiment of FIG. 1 in that the piezoelectric buzzer 14 is located on an internal surface of skin of the balloon 10 instead of on the external surface. Also, the sound module 22 may be arranged within the mouth 23 of the balloon if light enough to avoid interfering with flotation.

Conductive strands 16 of a ribbon conductor 32 are used (as in FIG. 1) to electrically connect the piezoelectric buzzer 14 and the sound module 22. The ribbon conductor 32 may be a two conductor plastic, heat-sealable, ribbon that is bonded or otherwise attached to the inside surface of the balloon and extends to the mouth 23 of the balloon. The manner of sound generation in the embodiment of FIG. 3 is the same as described in the embodiment of FIGS. 1-2.

The sound module 22 may be arranged either inside or outside the balloon. In an embodiment, the ribbon conductor 32 terminates beyond the mouth. In an alternate embodiment, the ribbon conductor 32 can have varying length, as desired. If balloon flotation is desired and the sound module 22 is light-weight enough to avoid adversely affecting flotation of the balloon, the sound module 22 may be arranged at the mouth or inside the balloon itself. (See, FIG. 5).

If the sound module 22 is inside the balloon, preferably it is secured at the mouth 23 of the balloon to avoid tilting the balloon in one direction over the other. The size of the sound module preferably is sufficiently small to fit within the confines of the mouth 23.

If the sound module 22 is outside of the balloon as in FIG. 3, then the ribbon conductor 32 extends through the mouth 23 of the balloon, which necessitates maintaining the integrity of the balloon's hermetic seal at the mouth 23 so the ribbon conductor 32 is preferably heat-sealable at that juncture. That is, gas within the balloon must not be permitted to pass between the ribbon 32 and the inside surface of the balloon or it will cause a leak.

The FIG. 3 embodiment is advantageous over that of FIGS. 1-2 in that no camouflage of the piezoelectric buzzer 14 is required, because the piezoelectric buzzer is hidden from view within the balloon.

In both of the embodiments of FIGS. 1-2 and 3, the balloon 10 is inflated until its skin or sheath is taut as opposed to loose, so as to provide superior sound quality with use of the piezoelectric buzzer.

Although a metallized balloon is disclosed in the drawings as the inflatable object, other types of inflatable objects may be substituted. Such inflatable objects include, but are not limited to, latex balloons, vinyl inflatables (such as those that appear as enlarged familiar objects such as beer bottles and soda cans), rafts, air pillows, air cushions, blow-up furniture items such as chairs, and any inflatable products such as balls, tires, blow-up toys, flotation toys, blimps.

Figure 4:
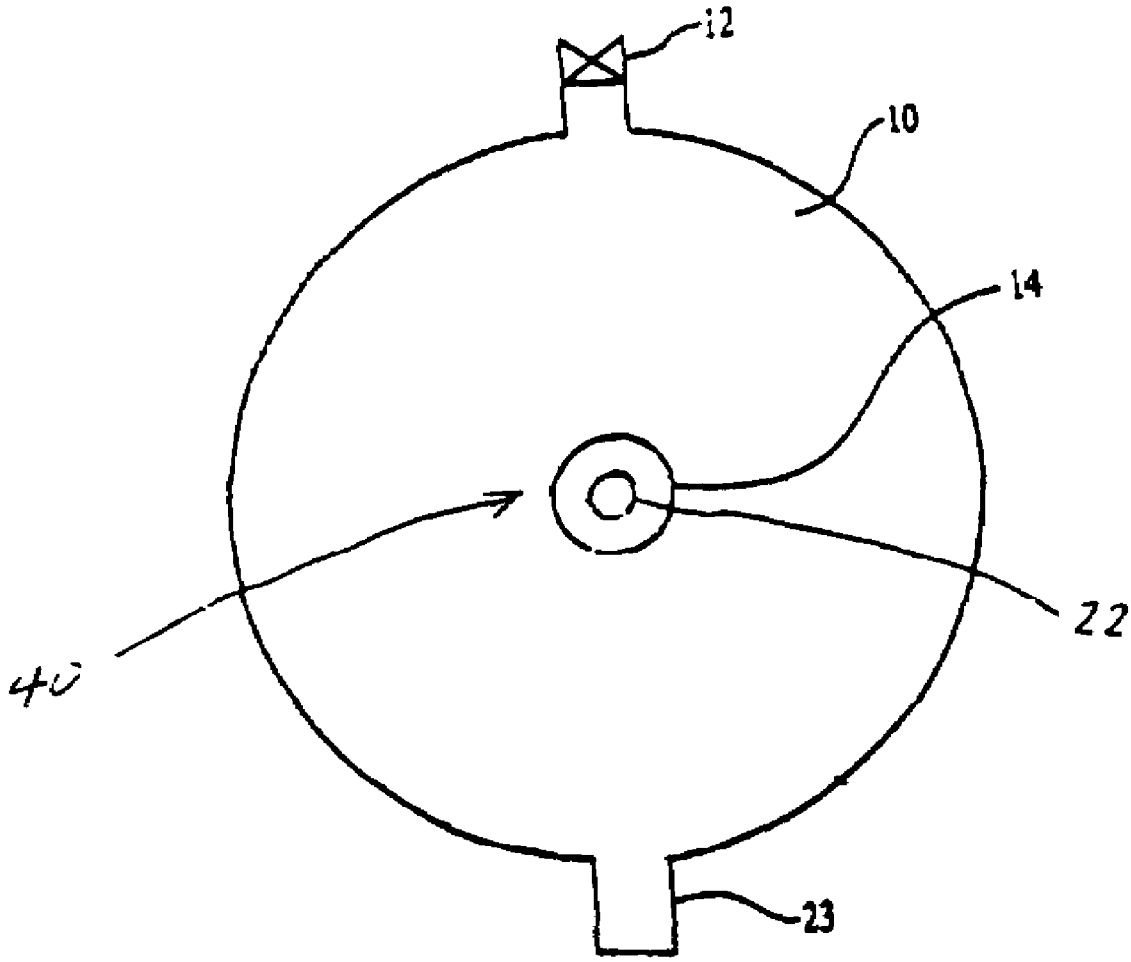
FIG. 4 illustrates an embodiment of the balloon having a piezoelectric buzzer and a sound module sharing a common housing, according to the present invention.

The piezoelectric buzzer and sound module of each of the embodiments of FIGS. 1-3 may be arranged within a common housing in the manner of the embodiment of FIG. 4 and the housing may be adhered to the desired surface, which tensions in response to variations in pressure within the inflated object. In an embodiment, the surface can be maintained continuously tensioned during an operational life of the balloon.

FIG. 4 shows the aforementioned Musical Sticker 40 adhered to the metallized balloon. The Musical Sticker 40 includes, within a common housing, a piezoelectric buzzer 14, a sound chip, batteries and all necessary electronics on a printed circuit board and connections to render the Musical Sticker 40 operative.

The triggering mechanism for the Musical Sticker 40 is actuated through touch. Further, a film piezoelectric (not shown) may be added to assist as the triggering mechanism for the piezoelectric buzzer, such as for the case where the piezoelectric buzzer is arranged within the metallized balloon. Alternatively, the piezoelectric buzzer itself may serve as the triggering mechanism.

The Musical Sticker 40 may contain a piezoelectric element that is double-sided for voice reproduction. The cover and base of the Musical Sticker 40 are secured to each other at their peripheries. A printed paper insert beneath the cover may be colored to blend in with the color scheme of the inflatable object to hide the components underneath from view. Alternatively, the plastic cover may be colored to avoid the need for the insert. If the Musical Sticker 40 is secured to the interior of the balloon, no such insert is needed.

An advantage in the use of a piezoelectric buzzer to generate the audio over the use of a piezoelectric film to generate the audio is that the piezoelectric buzzer is itself rigid, unlike the piezoelectric film that relies heavily on the rigidity of the balloon to amplify sounds. Further, the piezoelectric buzzer, is a much more efficient sound generator as the balloon becomes flaccid than is the case for the piezoelectric film.

In addition, the Musical Sticker type configuration as described is easily integrated into existing automated balloon manufacturing techniques, only requiring minor modifications of equipment to permit adherence of the Musical Sticker to the balloon. Further, the Musical Sticker may use conventional and reliable wire and solder connections instead of special and unreliable electro-mechanical connections that may be required between the piezoelectric film and the printed circuit board. As a result, the use of the piezoelectric buzzer over the piezoelectric film is more reliable and more cost efficient.

Figure 5:
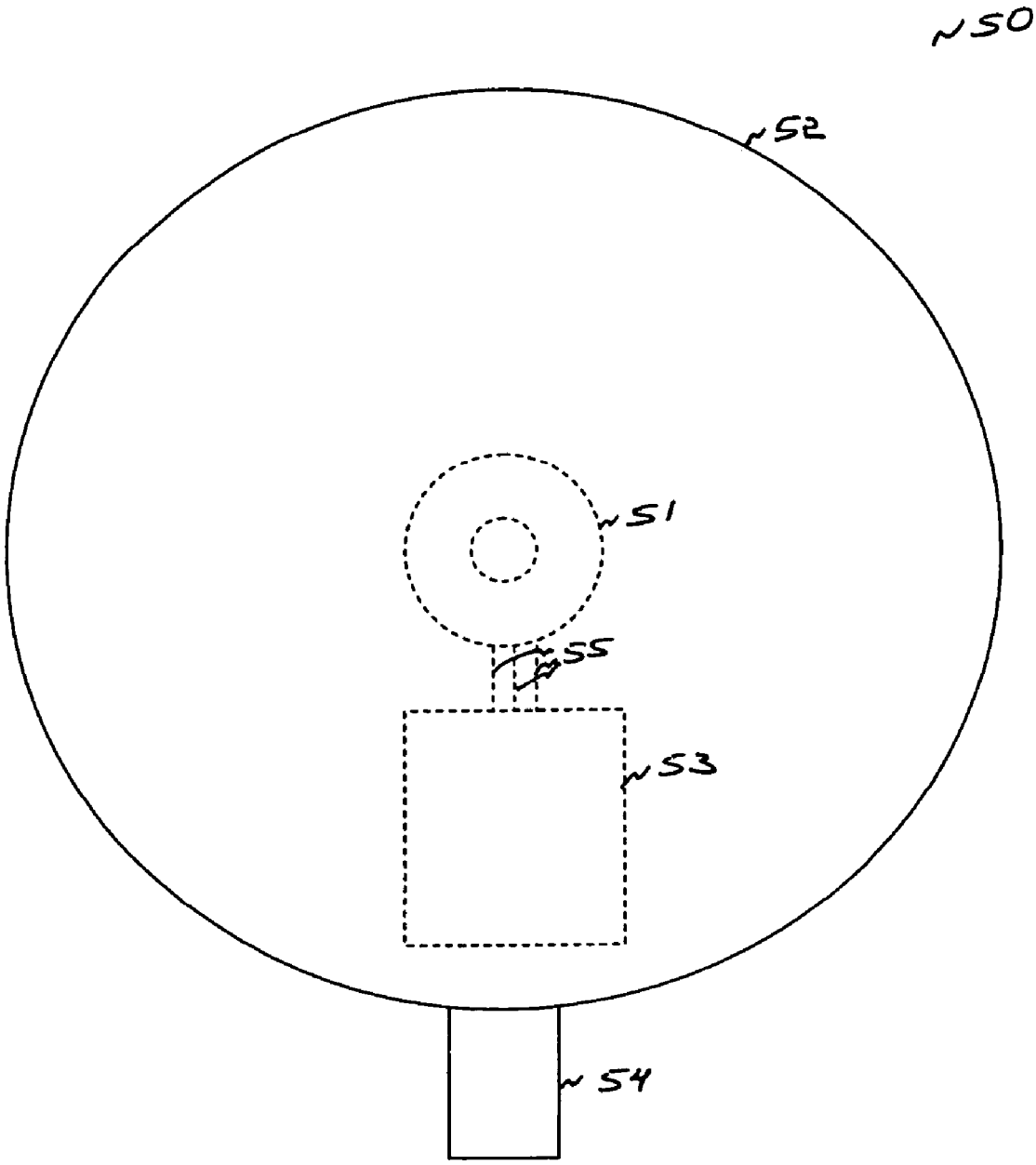
FIG. 5 illustrates an embodiment of the balloon having a piezoelectric buzzer a sound module arranged on the balloon's interior, according to the present invention.

FIG. 5 illustrates an alternate embodiment of a balloon 50, according to the present invention. The balloon 50 includes a balloon shell 52 coupled to a balloon mouth 54. The balloon shell 52 has inside and outside surfaces. The inside surface of the shell 52 encloses the interior of the balloon 50. The balloon mouth 54 can contain a balloon valve similar to the inlet valve 12 (not shown, but described with respect to FIGS. 1-4 above) through which the balloon 50 can be filled with a gaseous substance (air, gas, etc.).

The balloon 50 further includes a piezoelectric buzzer 51 electrically coupled to an electronics box 53 via a conductor 55. The piezoelectric buzzer 51 is similar to the piezoelectric buzzer 14 described with respect to FIGS. 1-4. In an embodiment, the buzzer 51 is attached to a portion of the inside surface of the balloon 50 and, hence, hidden from view, similar to FIG. 3. In an alternate embodiment, the buzzer 51 can be attached to a portion of the outside surface of the balloon 50 but also can be hidden from view, if a decorative cover is used, as shown in FIGS. 1-2.

Further, the buzzer 51 is attached to a portion of inside or outside surface of balloon 50, where the portion is continuously tensioned. This is advantageous in the event the balloon deflates and loses its overall rigidity, the piezoelectric buzzer 51 is still capable of generating quality polyphonic sounds. Further, the buzzer 51 can be attached to the balloon 50 either directly (i.e., to one of the balloon's surfaces) or indirectly (i.e., through a substrate or a lining).

The electronics box 53 contains electromechanical components for triggering operation of the balloon 50. Similar to the housing 20 of FIGS. 1-3, the electronics box 53 includes a voice/music chip, a switch, sound producing module, printed circuit board, a battery, and/or other circuit components. In an embodiment, the electronics box 53 is separate from the piezoelectric buzzer 51 and is connected to it via the conductor 55 (as shown in FIG. 5). In an alternate embodiment, the electronics box 53 incorporates the piezoelectric buzzer 51 and the conductor 55. In this case, the piezoelectric buzzer is still attached to the continuously tensioned surface of the balloon 50. The electronics box 53 can be coupled to the inside surface of the balloon 50. This is advantageous because the electronic components of the box 53 and wires are hidden from view. Further, this also reduces a risk of an electric shock from the box 53.

Since the balloon 50 has a hollow interior, any sound produced inside it would be significantly amplified. This is achieved by having sound waves resonate off the walls of the balloon 50. Hence, the balloon 50 serves as a sound amplifier. Further, because the buzzer 51 is attached to a tensioned surface of the balloon, the sound quality is sharper. As stated above, the piezoelectric buzzer is capable of generating polyphonic sounds, such as songs, melodies, rhythms, sound effects, nature sounds, mixed melodies, speech, and other continuous multi-tone multi-frequency sounds.

Figure 6:
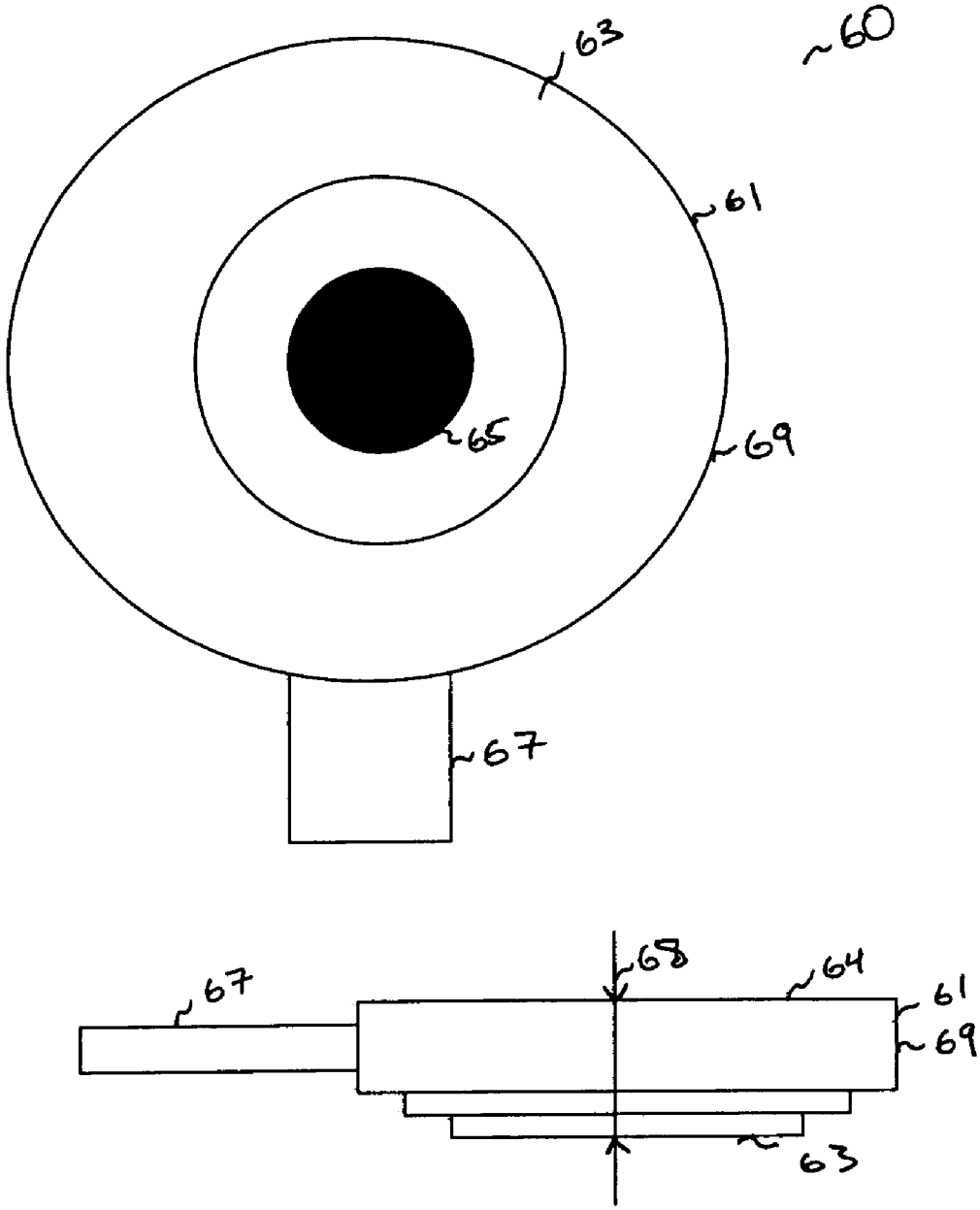
FIG. 6 illustrates an embodiment of a foam module incorporated into a balloon shown in FIGS. 1-5, according to the present invention.

FIG. 6 illustrates a top and a side view of a module 60 that can be incorporated into a balloon shown in FIGS. 1-5, according to the present invention. The module 60 can be attached either directly or indirectly to the balloon's inside or outside surface (not shown in FIG. 6). The module 60 includes an outer edge 61, a buzzer compartment 69, a tail 67 and an opening for piezoelectric buzzer 65. The buzzer compartment 69 further includes the piezoelectric buzzer. The tail 67 includes electronics components, which are electro-mechanically coupled to the buzzer in the buzzer compartment 69. The electronics can include a voice/music chip, a switch, sound producing module, printed circuit board, a battery, and/or other circuit components (not shown in FIG. 6, but described with respect to FIGS. 1-5). Further, to prevent damage to the electronics in the tail 67 during manufacture and packaging, they may be protected by a protective cap or cover disposed in the tail 67.

The buzzer compartment 69 further includes a first surface 63 and a second surface 64. The piezoelectric buzzer is placed between the first surface 63 and the second surface 64. In an embodiment, the buzzer can be directly or indirectly adhered to one or both of the surfaces 63 or 64. A thickness 68 of the buzzer compartment 69 allows for placement of the buzzer.

In an embodiment, the first and second surfaces 63, 64 can include the opening for piezoelectric buzzer 65. The piezoelectric buzzer opening 65 is placed in a center of the module 60. As can be understood by one having ordinary skill in the relevant art, such opening 65 can be placed in any other location of the module.

The surface 63 can have a stair-step design, as shown in FIG. 6. The second surface 64 can be laminated with a protective film, such as clear plastic, polyethylene, or any other suitable material. In an embodiment, the first surface 63 can be adhered to the balloon's inside or outside surface. In an alternate embodiment, the second surface 64 can be adhered to the balloon's inside or outside surface.

The tail 67 can also be adhered to the balloon's inside or outside surface. Additionally, the tail 67 can be placed adjacent the first surface 63 (forming a smooth surface with the first surface 63), near the second surface 64 (forming a smooth surface with the second surface 64) or somewhere in between the two surfaces of the module 60, as shown in FIG. 6.

The buzzer compartment 69 and the tail 67 can be manufactured from the same material such as foam, plastic, or any other suitable material. The module 60 can be attached to the balloon by heat-sealing, gluing, welding, or any other suitable methods. In an alternate embodiment, the module 60, once attached to the balloon, can be coated with a polyethylene or any other coat. This can be done to prevent the module from being detached from the balloon or damaged.

Further, a combination of the opening for piezoelectric buzzer 65, the buzzer compartment 69 and the tail 67 allows the module 60 to generate amplified polyphonic sounds having improved sound quality and projection.

In all embodiments, the present invention provides:

1) a sound source that generates sounds, 2) a piezoelectric buzzer that converts those signals into polyphonic sounds, such as songs, melodies, and other multi-tone continuous sounds, and 3) a balloon surface or a portion of a balloon surface that serves as a sounding board to amplify the audio sounds.

In an embodiment, the piezoelectric buzzer can be supported by a continuously tensioned surface, which does not lose its rigidity even if the balloon deflates. In an alternate embodiment, the piezoelectric buzzer can supported by a tensioned flexible surface, which keeps its rigidity as the balloon deflates.

Any type of conventional sound source and piezoelectric buzzer may be electronically connected together and the piezoelectric buzzer may be supported by the skin of the balloon. The conventional sound source may be either a cassette tape player, a compact disk player, a digital disk player, a radio or a sound chip, each with all the necessary electronics to render the sound source operative. The sound source may be powered by batteries or an alternating current source. While it is preferred that the conventional piezoelectric buzzer and the conventional sound source together be lightweight enough to avoid affecting flotation of the balloon adversely, they may be heavier-weight and still be suited for balloons that do not need to float, such as those to be hung from a ceiling. The piezoelectric buzzer may be directly or indirectly attached to the skin of the balloon and thus be supported by the skin of the balloon.

The audio sensing feature revealed in the aforementioned article in the IBM SYSTEMS JOURNAL, Vol. 35, Nos. 384 (1996) may be used in the present invention to respond to external audio sounds and noises. In this manner, a "conversation" may be made, with the sound generator of the present invention ceasing to generate sounds in response to sensed external audio and then resuming the generation of sounds after the sensed external audio stops.

While the description and drawings represent the preferred embodiments of the present invention, it will be understood that various changes and modifications may be made without departing from the spirit and scope of the present invention.

What is claimed is:

1. A balloon for producing polyphonic sounds, comprising:

a balloon having inside and outside surfaces and an enclosed gas expandable interior, where said inside surface encompasses said enclosed expandable interior;

an inlet for the controlled entry of a gas into said enclosed expandable interior of said balloon so as to expand said interior of said balloon;

a piezoelectric buzzer adhered to said balloon for producing polyphonic sounds;

said piezoelectric buzzer adhered to one of said inside or outside surface of said balloon in a fashion so that upon receiving audio signals generated by a voice/sound chip, said signals are converted into said polyphonic sounds that resonate within said balloon, wherein said balloon serves as a sound amplifier, and wherein said piezoelectric buzzer is configured to operate while at least a portion of one of said inside or outside surface to which it is attached is continuously tensioned and does not lose its rigidity even if the balloon deflates;

a sound module electrically connected to said piezoelectric buzzer and secured to said balloon;

said sound module including a circuit with said voice/sound chip;

said voice/sound chip adapted to generate the audio signals; and at least one battery arranged to power the sound module.

2. The balloon of claim 1, wherein said piezoelectric buzzer is directly adhered to said balloon.

3. The balloon of claim 1, wherein said piezoelectric buzzer is indirectly adhered to the balloon.

4. The balloon of claim 1, further comprising a common housing, wherein said piezoelectric buzzer and said sound module share said common housing.

5. The balloon of claim 1, wherein said sound module is coupled to said inside surface of said balloon and wherein said piezoelectric buzzer is coupled to said sound module.

6. The balloon of claim 1, further comprising a triggering mechanism.

7. The balloon of claim 6, wherein said triggering mechanism is responsive to touch, wherein said touch actuates said sound module and triggers said voice/sound chip to generate said audio signals.

8. The apparatus of claim 1, wherein said one of said inside or outside surface of the balloon that is attached to said piezoelectric buzzer that is maintained in a continuously tensioned manner maintains substantially all of its rigidity even if said balloon deflates.

9. The balloon of claim 1, wherein said polyphonic sounds are selected from a group consisting of: songs, melodies, speech, sound effects, multi-tone sounds, multi-tone frequency sounds, and continuous multiple frequency sounds.

10. The balloon of claim 1, wherein said balloon is manufactured from a material selected from a group consisting of: plastic, plastic film, metallized nylon-type, non-metallized nylon-type material, EVOH material and other film suitable for inflating.

11. A novelty apparatus for producing polyphonic sounds, comprising:

a balloon having inside and outside surfaces and an enclosed gas expandable interior, where said inside surface encompasses said enclosed expandable interior;

an inlet for the controlled entry of a gas into said enclosed expandable interior of said balloon so as to expand said interior of said balloon;

a piezoelectric buzzer adhered to said balloon for producing polyphonic sounds;

said piezoelectric buzzer adhered to one of said inside or outside surface of said balloon in a fashion so that upon receiving audio signals generated by a voice/sound chip, said signals are converted into said polyphonic sounds that resonate within said balloon, wherein said balloon serves as a sound amplifier, and wherein said piezoelectric buzzer is configured to operate while at least a portion of one of said inside or outside surface to which it is attached is continuously tensioned and does not lose its rigidity even if the balloon deflates;

a sound module electrically connected to said piezoelectric buzzer and secured to said balloon;

said sound module including a circuit with said voice/sound chip;

said voice/sound chip adapted to generate the audio signals; and at least one battery arranged to power the sound module.

12. The apparatus of claim 11, wherein said piezoelectric buzzer is directly adhered to said balloon.

13. The apparatus of claim 11, wherein said piezoelectric buzzer is indirectly adhered to the balloon.

14. The apparatus of claim 11, further comprising a common housing, wherein said piezoelectric buzzer and said sound module share said common housing.

15. The apparatus of claim 11, wherein said sound module is coupled to said inside surface of said balloon and wherein said piezoelectric buzzer is coupled to said sound module.

16. The apparatus of claim 11, further comprising a triggering mechanism.

17. The apparatus of claim 16, wherein said triggering mechanism is responsive to touch, wherein said touch actuates said sound module and triggers said voice/sound chip to generate said audio signals.

18. The apparatus of claim 11, wherein said one of said inside or outside surface of the balloon that is attached to said piezoelectric buzzer that is maintained in a continuously tensioned manner maintains substantially all of its rigidity even if said balloon deflates.

19. The apparatus of claim 11, wherein said polyphonic sounds are selected from a group consisting of: songs, melodies, speech, sound effects, multi-tone sounds, multi-tone frequency sounds, and continuous multiple frequency sounds.

20. The apparatus of claim 11, wherein said balloon is manufactured from a material selected from a group consisting of: plastic, plastic film, metallized nylon-type, non-metallized nylon-type material, EVOH material and other film suitable for inflating.

21. A balloon for producing polyphonic sounds, comprising:

a balloon having inside and outside surfaces and an enclosed gas expandable interior, where said inside surface encompasses said enclosed expandable interior;

an inlet for the controlled entry of a gas into said enclosed expandable interior of said balloon so as to expand said interior of said balloon;

a piezoelectric buzzer, for producing polyphonic sounds, adhered to one of said inside or outside surface of said balloon in a fashion so that upon receiving audio signals generated by a voice/sound chip, said signals are converted into said polyphonic sounds that resonate within said balloon, wherein said balloon serves as a sound amplifier;

a sound module electrically connected to said piezoelectric buzzer and secured to said balloon;

said sound module including a circuit with said voice/sound chip:

said voice/sound chip adapted to generate the audio signals;

at least one battery arranged to power the sound module; and said piezoelectric buzzer and said sound module share a common housing; and wherein said piezoelectric buzzer is configured to operate while at least one of said piezoelectric buzzer or said common housing is indirectly attached to a continuously tensioned portion of one of said inside or outside surface which does not lose its rigidity even if the balloon deflates.

22. A balloon for producing polyphonic sounds, comprising:

a balloon having inside and outside surfaces and an enclosed gas expandable interior, where said inside surface encompasses said enclosed expandable interior;

a piezoelectric buzzer, for producing polyphonic sounds, indirectly adhered to a continuously tensioned portion of one said inside or outside surface of said balloon which does not lose its rigidity even if the balloon deflates in a fashion so that upon receiving audio signals generated by a voice/sound chip, said signals are converted into said polyphonic sounds that resonate within said balloon while said balloon is inflated, wherein said inflated balloon serves as a sound amplifier;

a sound module electrically connected to said piezoelectric buzzer and secured to said balloon, wherein said sound module is directly or indirectly attached to one of said inside or outside surface of said balloon; and said sound module is configured to generate said polyphonic sounds, wherein said polyphonic sounds are amplified within said balloon.

23. A balloon for producing polyphonic sounds, comprising:

a balloon having inside and outside surfaces and an enclosed gas expandable interior, where said inside surface encompasses said enclosed expandable interior;

an inlet for the controlled entry of a gas into said enclosed expandable interior of said balloon so as to expand said interior of said balloon;

a piezoelectric buzzer, for producing polyphonic sounds, adhered to one of said inside or outside surface of said balloon in a fashion so that upon receiving audio signals generated by a voice/sound chip, said signals are converted into said polyphonic sounds that resonate within said balloon, wherein said balloon serves as a sound amplifier;

a sound module electrically connected to said piezoelectric buzzer and secured to said balloon;

said sound module including a circuit with said voice/sound chip;

said voice/sound chip adapted to generate the audio signals;

at least one battery arranged to power the sound module; and said piezoelectric buzzer is configured to operate while said piezoelectric buzzer is indirectly attached to a continuously tensioned portion of one of said inside or outside surface which does not lose its rigidity even if the balloon deflates.

24. A balloon for producing polyphonic sounds, comprising:

a balloon having inside and outside surfaces and an enclosed gas expandable interior, where said inside surface encompasses said enclosed expandable interior;

an inlet for the controlled entry of a gas into said enclosed expandable interior of said balloon so as to expand said interior of said balloon;

a piezoelectric buzzer, for producing polyphonic sounds, adhered to a continuously tensioned portion of said balloon which does not lose its rigidity even if the balloon deflates in a fashion so that upon receiving audio signals generated by a voice/sound chip, said signals are converted into said polyphonic sounds that resonate within said balloon, wherein said balloon serves as a sound amplifier;

a sound module configured to generate said audio signals and electrically connected to said piezoelectric buzzer, wherein said module is directly or indirectly secured to one of said inside or outside surface of said balloon; and said piezoelectric buzzer is directly or indirectly adhered to said sound module.

25. A balloon for producing polyphonic sounds, comprising:

a balloon having inside and outside surfaces and an enclosed gas expandable interior, where said inside surface encompasses said enclosed expandable interior;

an inlet for the controlled entry of a gas into said enclosed expandable interior of said balloon so as to expand said interior of said balloon;

a piezoelectric buzzer adhered to said balloon for producing polyphonic sounds;

said piezoelectric buzzer adhered to one of said inside or outside surface of said balloon in a fashion so that upon receiving audio signals generated by a voice/sound chip, said signals are converted into said polyphonic sounds that resonate within said balloon, wherein said balloon serves as a sound amplifier;

said piezoelectric buzzer is configured to operate while at least a portion of one of said inside or outside surface to which it is attached is continuously tensioned and does not lose its rigidity even if the balloon deflates; and an electronics box electrically coupled to said piezoelectric buzzer and configured to trigger operation of said balloon.

26. The balloon of claim 25, wherein said electronics box comprises a sound module that further comprises a circuit with said voice/sound chip.

27. The balloon of claim 26, wherein said voice/sound chip is configured to generate the audio signals.

28. The balloon of claim 26, wherein said electronics box further comprises at least one battery configured to power said sound module.

29. The balloon of claim 25, wherein said electronics box further comprises a triggering mechanism.

30. The balloon of claim 29, wherein said triggering mechanism is responsive to touch, wherein said touch actuates said sound module and triggers said voice/sound chip to generate said audio signals.

31. The balloon of claim 25, wherein said polyphonic sounds are selected from a group consisting of: songs, melodies, speech, sound effects, multi-tone sounds, multi-tone frequency sounds, and continuous multiple frequency sounds.

32. The balloon of claim 25, wherein said balloon is manufactured from a material selected from a group consisting of: plastic, plastic film, metallized nylon-type, nm-metallized nylon-type material, EVOH material and other film suitable for inflating.

33. An apparatus for producing polyphonic sounds, comprising:

a balloon having inside and outside surfaces and an enclosed gas expandable interior, wherein said inside surface bounds said enclosed expandable interior;

an inlet configured to enable entry of a gas into said enclosed expandable interior of said balloon so as to expand said interior of said balloon;

a speaker attached to a continuously tensioned portion of said inside or outside surface of said balloon which does not lose its rigidity even if the balloon deflates and configured to produce polyphonic sounds that resonate off of said balloon, wherein said balloon serves as a sound amplifier; and a sound module electrically connected to said speaker and attached to said balloon.

34. The apparatus of claim 33, further comprising at least one battery arranged to power said sound module and wherein said sound module including a circuit with a voice/sound chip and said voice/sound chip adapted to generate audio signals, said speaker being configured to convert said audio signals into said polyphonic sounds.

35. The apparatus of claim 33, wherein said speaker is a piezoelectric buzzer.

36. The apparatus of claim 33, wherein said continuously tensioned portion of said inside or outside surface of said balloon maintains substantially all of its rigidity even if said balloon deflates.

37. An apparatus for producing polyphonic sounds, comprising:

a balloon having an enclosed gas expandable interior;

an inlet configured to enable entry of a gas into said enclosed expandable interior of said balloon so as to expand said balloon;

a speaker supported by a continuously tensioned surface of the balloon within said enclosed expandable interior, which does not lose its rigidity even if the balloon deflates;

a sound module electrically connected to said speaker to generate polyphonic sounds, said sound module being coupled to said balloon; and said sound module including a circuit with a voice/sound chip that is adapted to generate audio signals, said speaker being configured to convert said audio signals into said polyphonic sounds that resonate within said balloon, wherein said balloon serves as a sound amplifier.

38. The apparatus of claim 37, wherein said speaker is a piezoelectric buzzer.

* * * * *